US005103196A

United States Patent [19]

Nakano et al.

[11] Patent Number: 5,103,196

[45] Date of Patent: Apr. 7, 1992

[54] MICROSTRIP LINE HAVING A CHANGED EFFECTIVE LINE LENGTH

[75] Inventors: Yoshiaki Nakano, Ootawara; Akira Watanabe, Sendai, both of Japan

[73] Assignee: Fujitsu Limited, Japan

[21] Appl. No.: 615,543

[22] Filed: Nov. 19, 1990

[30] Foreign Application Priority Data

Nov. 21, 1989 [JP] Japan ..... 1-300684

[51] Int. Cl.[5] ..... H01P 1/18; H01P 5/00

[52] U.S. Cl. ..... 333/161; 333/246

[58] Field of Search ..... 333/161, 238, 246; 361/408

[56] References Cited

U.S. PATENT DOCUMENTS 3,548,344 12/1970 Putz ..... 333/28
3,656,179 4/1972 De Loach .
3,995,239 11/1976 Head et al. ..... 333/238 X
3,997,851 12/1976 Sechi ..... 333/238 X
4,064,356 12/1977 Marler, Jr. et al. ..... 361/408 X
4,187,480 2/1980 Frazita ..... 333/161
4,388,599 6/1983 Gautier et al. ..... 333/161 X

FOREIGN PATENT DOCUMENTS 63-220604 9/1988 Japan .
1-218103 8/1989 Japan .

*Primary Examiner*—Paul Gensler
*Attorney, Agent, or Firm*—Armstrong, Nikaido, Marmelstein, Kubovcik & Murray

[57] ABSTRACT

A microstrip line having a shortened line length, includes at least one conductive wire connected between two desired points of a strip conductor through a medium having a second dielectric constant which is smaller than a first dielectric constant. The strip conductor is formed on a substrate which has the first dielectric constant. The effective length of the microstrip line is therefore shorter than the physical length of the microstrip line.

10 Claims, 4 Drawing Sheets

MICROSTRIP LINE HAVING A CHANGED EFFECTIVE LINE LENGTH

BACKGROUND OF THE INVENTION (1) Field of the Invention

The present invention relates to a microstrip line having a changed effective line length and a method of manufacturing same. The microstrip line is used for constructing a microwave integrated circuit.

In a microwave integrated circuit, microstrip lines such as a transmission line, an open stub, a short stub, etc., are formed by conductive patterns. There are cases where it is desirable to shorten the length of these microstrip lines in accordance with necessary circuit constants.

(2) Description of the Related Art

In the conventional art, it was difficult to obtain a shortened microstrip pattern from an existing microstrip pattern, because, if the existing microstrip pattern is cut to obtain the required shortened pattern, the substrate under the microstrip line may also be destroyed. Therefore, conventionally, a shortest pattern and various stubs are prepared in advance, and a pattern of a desired electric virtual length is obtained by a combination of the shortest pattern and one or more of the various stubs. This, however, causes problems in that not only are the manufacturing processes annoying and complex, but also there is no freedom for adjustment of the length since the previously prepared patterns have fixed lengths. When only one pattern of a transmission line is used, there is a problem in that a pattern shorter than the above-mentioned single pattern cannot be realized.

SUMMARY OF THE INVENTION

An object of the present invention is to provide a microstrip line having an electrical length shorter than its physical length without shortening the physical length of the microstrip line, and a method of manufacturing the same.

To attain the above object, there is provided, according to the present invention, a microstrip line having a shortened line length, comprising: a dielectric substrate having a first dielectric constant; a strip conductor with a predetermined physical length and provided on a surface of the dielectric substrate; and at least one conductive wire connected between two desired points of the strip conductor through a medium having a second dielectric constant smaller than the first dielectric constant.

According to the present invention also, there is provided a method for changing an effective length of a microstrip line, the microstrip line comprising: a dielectric substrate having a first dielectric constant; and a strip conductor with a predetermined physical length provided on a surface of the dielectric substrate; the method comprising the step of connecting at least one conductive wire between two desired points of the strip conductor through a medium having a second dielectric constant smaller than the first dielectric constant.

By connecting the conductive wire between two desired points of the strip conductor through a medium having a second dielectric constant smaller than the first dielectric constant, the effective length of the microstrip line is made shorter than the physical length thereof.

BRIEF DESCRIPTION OF THE DRAWINGS

The above object and features of the present invention will be more apparent from the following description of the preferred embodiment with reference to the accompanying drawings, wherein.

DESCRIPTION OF THE PREFERRED EMBODIMENT

For better understanding of the present invention, a conventional art and the problems therein are first described with reference to FIGS. 1 and 2.

Figure 1:
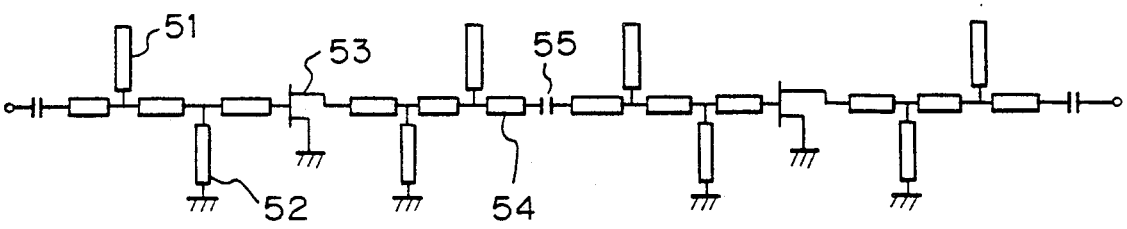
Fig. 1 PRIOR ART
FIG. 1 is a diagram of a pattern arrangement of a conventional microwave integrated circuit.

FIG. 1 is a diagram showing a pattern arrangement of a two-stage amplifier as an example of a conventional microwave integrated circuit. In the figure, 51 is an open stub having an open end, 52 is a short stub having a grounded end, 53 is a field effect transistor (FET), 54 is a transmission line, and 55 is a capacitor for blocking a direct current. The lengths of the microstrip lines such as the open stub 51, the short stub 52, the transmission line 54, etc., are often required to be made longer or shorter in accordance with a circuit constant.

When, for example, the pattern of the transmission line 54 is cut to obtain a shortened pattern, however, the substrate under the pattern 54 will be destroyed. Therefore, it is impossible to cut the pattern.

Figure 2:
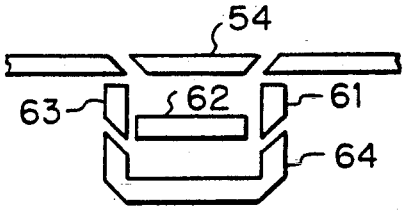
Fig. 2 PRIOR ART
FIG. 2 is a diagram for explaining a conventional method for changing the effective length of a transmission line.

FIG. 2 is a diagram for explaining a conventional method for shortening the effective length of the above-mentioned transmission line 54. As shown in the figure, conventionally, for example, a route consisting of patterns 61, 62, and 63 and a route consisting of a pattern 64 are provided in the proximity of the pattern of the transmission line 54. By connecting an appropriate one among these routes to the pattern of the transmission line 54 in accordance with necessity, it is possible to change the effective length of the transmission line 54 in three stages where only the pattern 54 is used, the patterns 54, 61, 62, and 63 are used, and the patterns 54, 61, 64 and 63 are used.

Namely, when the length is to be shortened, patterns 61 to 64 and the like should be prepared in advance. This, however, causes a problem in that not only are the preparation processes annoying and complex, but also there is no freedom for adjustment of the length since the previously prepared patterns have fixed lengths.

An object of the present invention is to form a microstrip line having an electrical length shorter than the physical length without shortening the physical length of the stripline.

Figure 3A:
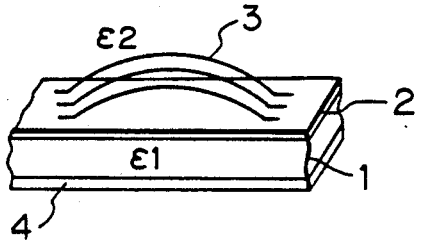
FIGS. 3A–3B are diagrams for explaining the principle of the present invention.
Figure 3B:
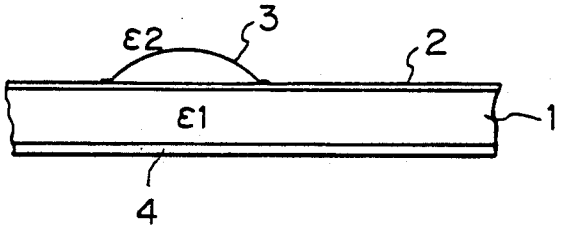

FIGS. 3A and 3B are a perspective view and a side view respectively of a microstrip line obtained according to an embodiment of the present invention. In the figures, 1 is a dielectric substrate having a first dielectric constant $\epsilon 1$,2 is a strip conductor mounted on the surface of the dielectric substrate 1 and having a predetermined physical length, and 4 is a ground pattern under the dielectric substrate 1. According to the present invention, between the two desired points on the strip conductor 2, and through a medium such as air having a second dielectric constant $\epsilon 2$ smaller than the first dielectric constant $\epsilon 1$, at least one conductive wire 3 is connected. By connecting the conductive wire 3, the virtual electrical length of the strip conductor 2 is made shorter than the physical length.

In general, in two lines having the same physical line lengths, the electrical length with a surrounding medium of a lower dielectric constant is shorter than with a medium of a higher dielectric constant. The present invention is provided based on this principle.

The ratio between the impedance of the strip conductor 2 and the impedance of the conductive wires 3 is largely influenced by the number of the conductive wires 3. Namely, the larger than number of conductive wires is, the greater the influence of the dielectric constant $\epsilon 2$ surrounding the conductive wires 3 becomes. Accordingly, the larger the number of the conductive wires 3 is, the shorter the electrical length of the strip conductor as a whole becomes.

By simply connecting the conductive wires 3 to the strip conductor 2 in accordance with necessity, a microstrip line composed of the conductive wires 3 and the strip conductor 2 has an effective length shorter than that of the original strip conductor 2, so that the process is simple and allows great freedom in adjusting the length of the microstrip line.

Figure 4:
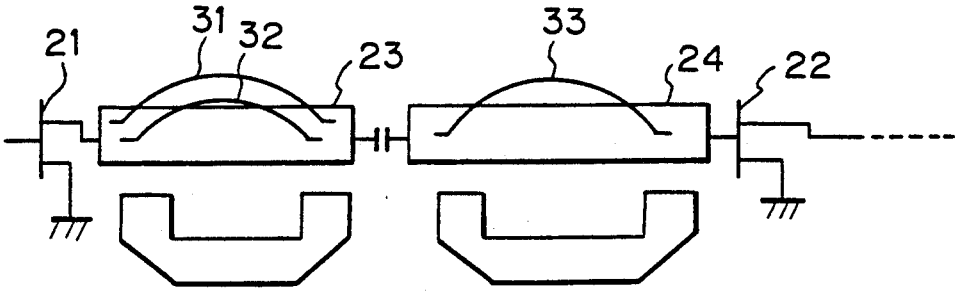
FIG. 4 is a diagram for explaining the method of adjusting the length of a microstrip line between stages of a two-stage FET amplifier as an example of a microwave integrated circuit according to an embodiment of the present invention.

FIG. 4 is a diagram for explaining the method for adjusting the length of a microstrip line between stages of a two-stage FET amplifier as an example of a microwave integrated circuit according to an embodiment of the present invention. In the figure, when the microstrip line formed by straight line patterns 23 and 24 connected in series between FETs 21 and 22 is too long, a desired number of gold wires 31, 32, and 33 are connected in parallel between desired points on the patterns 23 and 24, whereby a desired electrical line length or close to it can be obtained. In this case, by connecting the wires 31, 32, and 33, it may be considered that the impedance of the line as a whole is increased. Therefore, it is preferable to determine the line width of the wire to such a degree that the impedance is not seriously deteriorated even when the number of the wires is changed to a certain extent.

Figure 5:
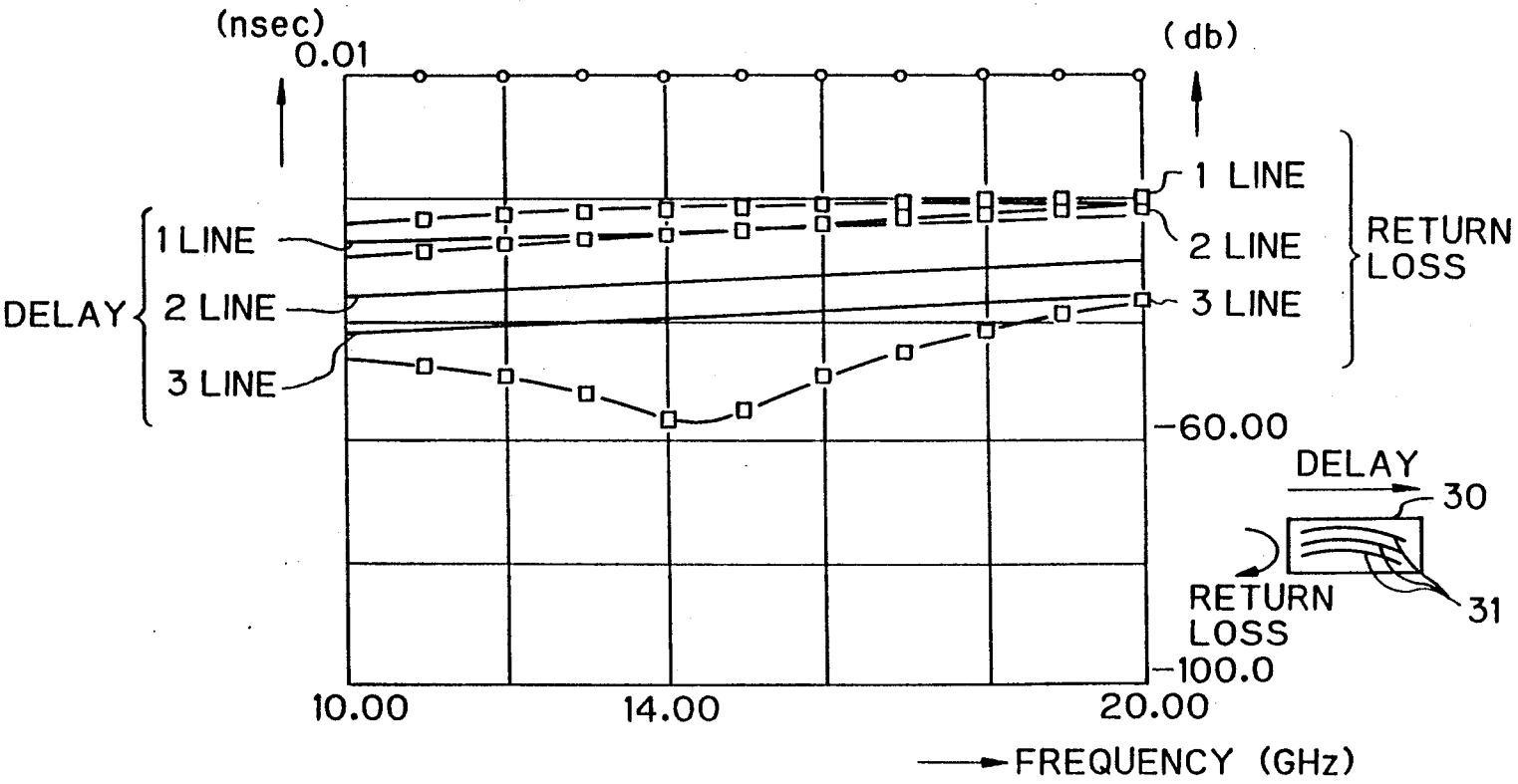
FIG. 5 is a simulation graph showing changes in the amount of delay and impedance according to an embodiment of the present invention.

FIG. 5 is a graph of a simulation showing the change of the delay amount and return loss when the gold wires 31, 32, and 33 are connected to a transmission line 30. In the figure, the horizontal axis represents the frequency in units of Ghz, the right-hand side of the vertical axis represents the return loss in dB, and the left-hand side of the vertical axis represents the delay amount in nano seconds. As can be seen from the figure, in accordance with an increase in the number of the wires 31, the amount of delay is decreased. Namely, the larger the number of the wires is, the shorter the electrical length of the total microstrip line becomes. In other words, the larger the number of the wires is, the smaller the phase delay of the signal transmitted through the microstrip line becomes. The return loss is only up to −20 dB even when one or more of the gold wires 31 are connected to the transmission line 30. Such a degree of return loss does not seriously influence the impedance of the transmission line 30.

Figure 6:
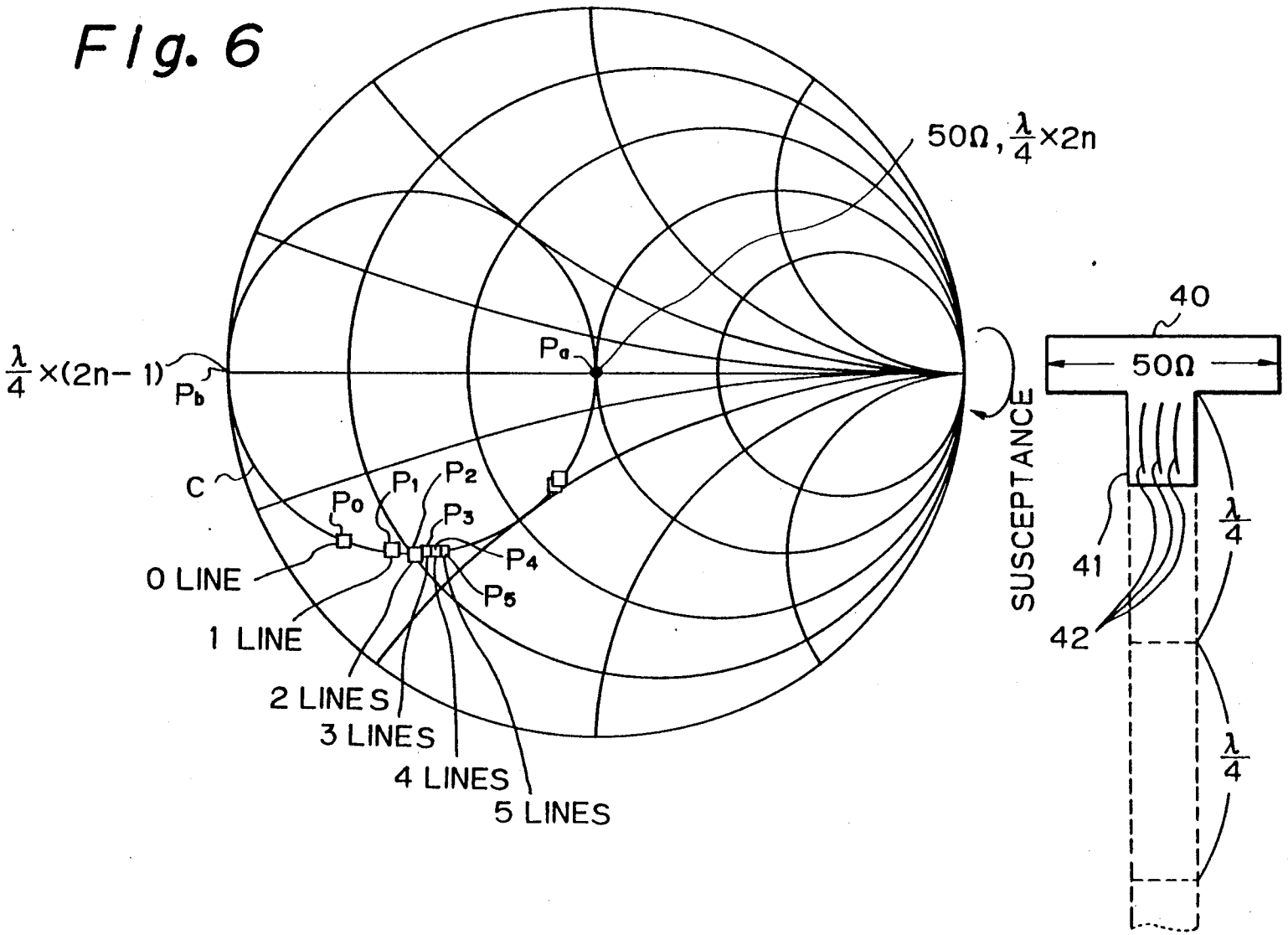
FIG. 6 is a simulation graph showing changes of susceptance according to an embodiment of the present invention.

FIG. 6 is a simulation graph in the form of a Smith chart showing a change of susceptance when one or more gold wires 42 are connected to an open stub 41 which is connected to a transmission line 40 having a characteristic impedance of 50 Ω. As can be seen from the figure, along with an increase in the number of the gold wires, the susceptance of the total microstrip line is increased. Namely, in the Smith chart in FIG. 6, a circle C represents a change in the susceptance of the total transmission line comprised of the transmission line 40 and the open stub 41 when the length of the open stub 41 changes. The point $P_a$ in the chart represents the case when the open stub 41 has a length of $\xi/4$ multiplied by 2n where n is 0, 1, 2, 3, ... , and $\xi$ is the wave length of the signal transmitted through the transmission line 40. In this case, the impedance of the total transmission line is 50 Ω. The point $P_b$ different from the point $P_a$ by a phase angle of 180 degrees represents the case when the open stub 41 has a length of $\xi/4$ multiplied by $(2n+1)$, where n is 0, 1, 2, 3, ... . By increasing the length of the open stub 41 from zero to $\xi/4$, the susceptance of the total transmission line changes along the circle C from the point $P_a$ through points $P_5$, $P_4$, $P_3$, $P_2$, $P_1$, $P_0$, to the point $P_b$. In the illustrated example, it is assumed that the open stub 41 without the gold wire 42 has a certain length so that the susceptance of the total transmission line 40 without the gold wire 42 is expressed by the point $P_0$. From this state, when one, two, three, four, and five gold wires 42 are connected, the susceptances of the total transmission line are respectively expressed by the points $P_1$, $P_2$, $P_3$, $P_4$, and $P_5$. This means that, increasing the number of the gold wires 42 is equivalent to decreasing the length of the open stub 41.

By this also, it is understood that the larger the number of the wires is, the shorter the electrical length of the total microstrip line becomes.

In the above explanation, examples were given for the cases where the electrical length of a transmission line without an open stub and a transmission line with an open stub are shortened.

As the conductive wires, examples utilizing gold wires were given, however, other metal wires used as transmission lines may also be used as the conductive wires.

As will be apparent from the foregoing description, according to the present invention, by simply connecting conductive wires to a strip conductor in accordance with necessity, the total microstrip line obtained by composing the conductive wires and the strip conductor has an effective length shorter that the original microstrip line, so that the process is simple and allows a great amount of freedom in adjusting the length.

Also, to adjust the line length, it is not necessary to cut stubs and so forth so that easy adjustment is possible.

We claim:

1. A microstrip line having a shortened line length, comprising:

a dielectric substrate having a first dielectric constant;

a ground pattern formed under said dielectric substrate;

a strip conductor, with a predetermined physical length, provided on a surface of said dielectric substrate; and at least one conductive wire connected between two desired points of said strip conductor through a medium having a second dielectric constant which is smaller than said first dielectric constant.

2. A microstrip line as claimed in claim 1, wherein said medium is air.

3. A microstrip line as claimed in claim 1, wherein said conductive wire is a gold wire.

4. A microstrip line as claimed in claim 1, wherein a plurality of conductive wires are connected in parallel between said two desired points of said strip conductor through said medium.

5. A microstrip line as claimed in claim 1, wherein said conductive wire is so connected as to make an effective length of said microstrip line shorter than the physical length of said microstrip line.

6. A method for changing an effective length of a microstrip line, said microstrip line comprising:

a dielectric substrate having a first dielectric constant;

a ground pattern formed under said dielectric substrate; and a strip conductor, with a predetermined physical length, provided on a surface of said dielectric substrate;

said method comprising the step of:

connecting at least one conductive wire between two desired points of said strip conductor through a medium having a second dielectric constant which is smaller than said first dielectric constant.

7. A method as claimed in claim 6, wherein said medium is air.

8. A method as claimed in claim 6, wherein said conductive wire is a gold wire.

9. A method as claimed in claim 6, further comprising the step of connecting a plurality of conductive wires in parallel between said two desired points of said strip conductor through said medium.

10. A method as claimed in claim 6, wherein said conductive wire is so connected as to make an effective length of said microstrip line shorter than the physical length of said microstrip line.

* * * * *